United States Patent [19]

Isobe

[11] 4,024,671

[45] May 24, 1977

[54] MUTUALLY COUNTERBALANCING UPPER AND LOWER FLAP DOORS OF WIDE DOORWAY

[75] Inventor: Masao Isobe, Takasaki, Japan

[73] Assignee: Daiwa Jidosha Kogyo Kabushiki Kaisha, Takasaki, Japan

[22] Filed: Sept. 23, 1975

[21] Appl. No.: 615,855

[30] Foreign Application Priority Data

Feb. 1, 1975 Japan ..... 50-71791[U]

[52] U.S. Cl. ..... 49/104; 296/51

[51] Int. Cl.² ..... E05C 7/06

[58] Field of Search ..... 49/73, 104, 115, 116, 49/121, 119, 123, 371, 366, 367; 296/22, 51, 28 M, 146

[56] References Cited

UNITED STATES PATENTS

| | | | |
|---|---|---|---|
| 1,067,146 | 8/1913 | Schoell | 160/92 |
| 2,220,202 | 11/1940 | Bohne | 296/51 |
| 2,249,932 | 7/1941 | Beale | 296/51 |
| 2,538,930 | 1/1951 | Zummach | 296/51 X |
| 2,606,786 | 8/1952 | Howard | 296/28 M |
| 2,772,913 | 12/1956 | Holan et al. | 296/28 M |

FOREIGN PATENTS OR APPLICATIONS

| | | | |
|---|---|---|---|
| 1,379,811 | 10/1963 | France | 49/73 |
| 336,619 | 10/1930 | United Kingdom | 49/104 |

*Primary Examiner*—Roy D. Frazier
*Assistant Examiner*—Terrell P. Lewis
*Attorney, Agent, or Firm*—Ladas, Parry, Von Gehr, Goldsmith & Deschamps

[57] ABSTRACT

Upper and lower flap doors respectively hinged to an upper lintel member and to a lower sill member of a doorway frame constituting almost the entire side wall of the body of a van type motortruck to swing open respectively outwardly and upwardly to a horizontal position and outwardly and downwardly to a vertical position are intercoupled by a coupling device comprising two coupling mechanisms installed close to two posts constituting side members of the doorway frame, each coupling mechanism comprising members intercoupling the flap doors to synchronize their movements and cause gravitational forces acting thereon to counterbalance each other, thereby reducing the physical effort required for manual opening and closing of the doors.

5 Claims, 8 Drawing Figures

MUTUALLY COUNTERBALANCING UPPER AND LOWER FLAP DOORS OF WIDE DOORWAY

BACKGROUND OF THE INVENTION

This invention relates generally to flap doors, particularly those rotatable about horizontal hinge lines, and to hollow structures. More particularly, the invention relates to a combination of upper and lower flap doors for closing and opening a large opening in the wall of a structure such as a vehicle body, which doors are intercoupled by a mechanism in a manner such that torques due to gravity acting on the flap doors substantially counterbalance each other, whereby opening and closing manipulation of the flap doors is greatly facilitated and made smooth.

Heretofore, flap doors of the above mentioned character such as side boards of truck bodies have generally been opened and closed by hand in most cases. Where only a single flap door of relative small width (in the vertical direction perpendicular to the hinge line) is involved for each wall as in the case of a compact or medium sized truck, the manual operation thereof is simple and does not require much effort. However, in the case where a flap door is of considerable width, or where two flap doors, one above the other, are used, as in a large closed van of high ceiling whose side wall must be opened, the manual handling of the wide door or the two doors requires considerable physical strength and labor. Furthermore, there may be some danger of injury to the operator due to mishandling. In such a case, the door or doors can be power driven by means such as hydraulic cylinders, but such devices are expensive.

SUMMARY OF THE INVENTION

It is an object of this invention to provide upper and lower flap doors in a doorway in a wall of a hollow structure which doors cover almost the entire expanse of the side wall yet can be fully opened into positions at which they cannot obstruct the passage of objects through the doorway.

Another object of the invention is to provide flap doors as stated above which are intercoupled by a balanced coupling device in a manner whereby the two doors are synchronized in their opening and closing movements, and gravitational forces acting on the two doors are cause to substantially counterbalance each other thereby to reduce greatly the physical force required to move manually the doors in opening and closing movements and to eliminate the danger of injury to the operator.

Still another object is to provide flap doors as stated above in which the balanced coupling device is of simple and inexpensive construction and reliable operation.

According to this invention, briefly summarized, there is provided, in a hollow structure having a large wall opening bordered by a doorway frame, the combination therewith of upper and lower flap doors respectively hinged to upper and lower members of the doorway frame to swing respectively from closed positions to fully opened positions at which both doors are clear of possible paths of objects passing through the doorway and a device for intercoupling the two flap doors in a manner to synchronize their movements and to cause gravitational forces acting respectively thereon to substantially counterbalance each other thereby to reduce the force required to manually open and close the doors.

The nature, utility, and further features of this invention will be more clearly apparent from the following detailed description with respect to specific embodiments of the invention when read in conjunction with the accompanying drawings, throughout which like parts are designated by like reference numerals and characters.

DETAILED DESCRIPTION

Figure 1:
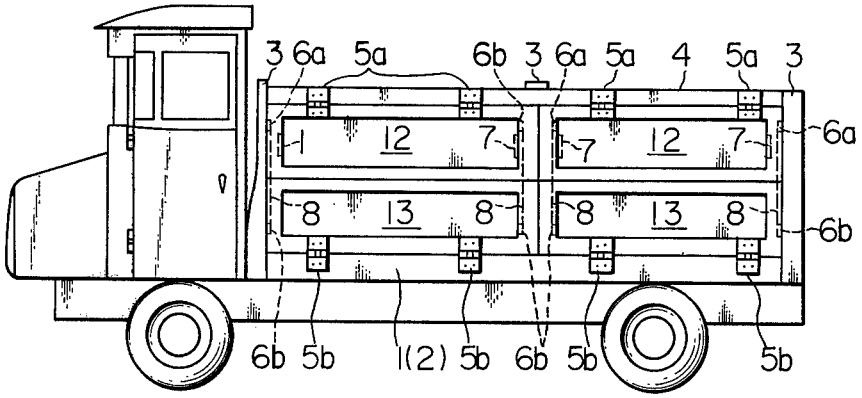
FIG. 1 is a left side elevation of a motortruck having a body provided in openings of its side walls with flap doors according to the invention.

In a first example of the invention as illustrated in FIGS. 1 through 4, the invention is applied to a motortruck of van type. The cargo carrying part of the body of this truck has a cargo platform or deck 1 with a peripheral frame 2. At the four corners of the peripheral frame 2, and at an intermediate point in the lateral member of the frame in the case of a large truck, there are fixed stanchions or posts 3, which support a horizontal upper frame member 4 on each lateral side of the truck. Thus, each combination of the frame member 4, two posts 3, and the deck frame 2 form a doorway frame, these parts corresponding respectively to the lintel, jambs, and sills of an ordinary doorway frame. There are two of these doorway frames arranged fore-and-aft on each side of the truck in the instant example.

Figure 4:
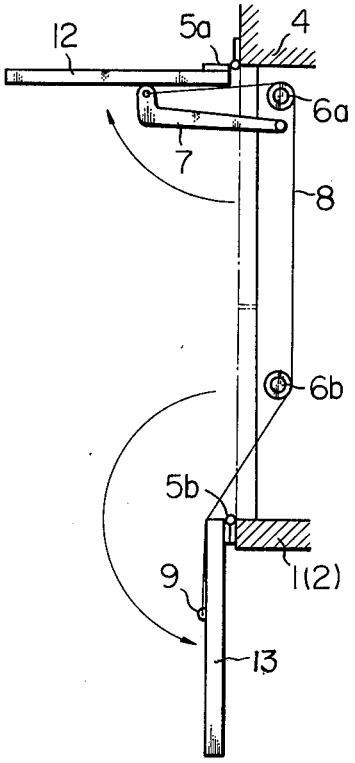
Figure 5:
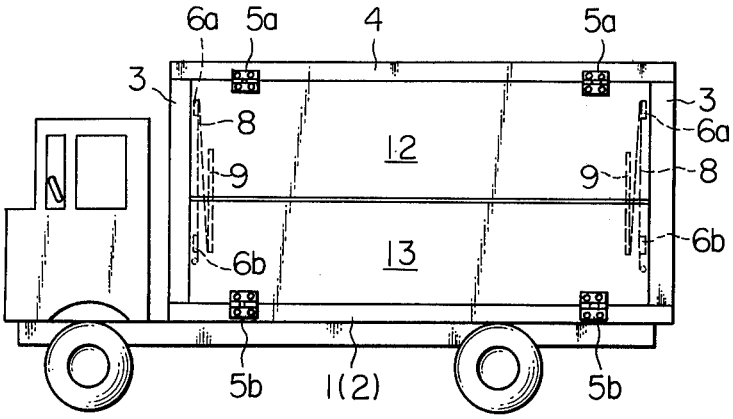
FIG. 5 is a left side elevation of another motortruck having a van type body provided in a large side wall opening on each side with a large doorway with flap doors according to the invention.
Figure 6:
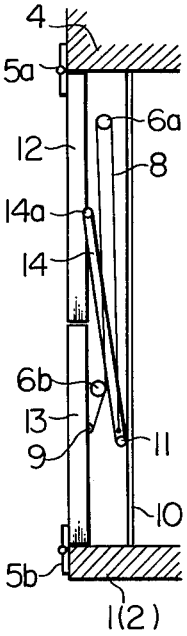
FIGS. 6, 7, and 8 are elevational views taken in a transverse plane perpendicular to the view of FIG. 5 and showing the essential construction of the flap doors as illustrated in FIG. 5 and another example of a balanced coupling mechanism one side thereof, these views respectively indicating the doors and the mechanism in the fully closed state, a partially opened state, and the fully opened state.

Within the opening of each doorway frame, there are provided an upper flap door 12 for closing the upper portion of the opening and a lower flap door 13 for closing the lower, remainder portion of the opening. The upper flap door 12 is swingably hinged at its upper edge by hinges **5*a* to the upper frame member 4 and is swingable outwardly and upwardly from its vertically suspended closed state shown in FIG. 2 through an angle somewhat greater than 90° to a state as shown in FIG. 4. The lower flap door 13 is swingably hinged at its lower edge by hinges 5*b* to the lateral member of the peripheral frame 2 and is swingable outwardly and downwardly from its vertical closed state shown in FIG. 2**, in which it lies in substantially the same vertical plane as the closed upper flap door, through an approximately 180° to a vertically suspended, fully open state as shown in FIG. 4.

Figure 2:
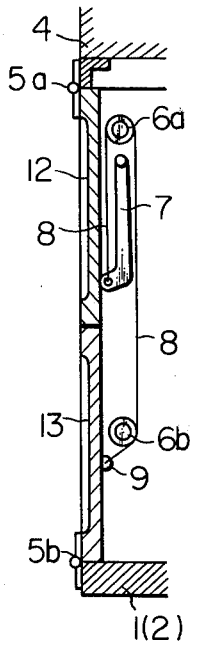
FIGS. 2, 3, and 4 are elevational views taken in a transverse plane perpendicular to the view in FIG. 1 and showing the essential construction of one example of flap doors as illustrated in FIG. 1 and a balanced coupling mechanism on one side thereof, these views respectively indicating the doors and the mechanism in the fully closed state, a partially opened state, and the fully opened state.

In closed state as shown in FIG. 2, the upper and lower flap doors 12 and 13 lie substantially in the same plane and fully close the opening in the doorway frame, the lower edge of the upper flap door 12 and the upper edge of the lower flap door 13 being in sealing contact or closely fitting each other. In fully opened state, these upper and lower flap doors 12 and 13 are as described above, whereby they are clear of the possible path of any cargo being loaded or unloading onto or off the truck cargo deck 1.

In accordance with this invention, as mentioned briefly hereinbefore, each pair of the upper and lower flap doors 12 and 13 is intercoupled by a balanced coupling device of the following description. This device is made up of two identical, balanced coupling mechanisms disposed respectively at the fore and aft ends of the flap doors 12 and 13 installed close to or within hollow spaces of the respective posts 3 adjacent to the fore and aft ends of the flap doors.

Each of these mechanisms has an upper sheave or pulley 6*a* rotatably supported on the pertinent post 3 or a structural extension thereof at a height position somewhat below the hinge line of the upper flap door 12 and a horizontal position somewhat inboard from the same hinge line and a lower pulley 6*b* rotatably supported on the same post 3 at a position between the hinge lines of the upper and lower flap doors 12 and 13 and substantially vertically below the upper pulley 6*a*.

A lever 7 is pivoted at its proximal end about a pivot pin fixed to the post 3 and disposed close to and directly below the upper pulley 6*a* and has a distal end which is bent at approximately right angles to the principal portion of the lever and projects toward the upper flap door 12. A wire cable 8 is anchored at its one end to the extreme projecting bent end of the lever 7 and is passed around the upper pulley 6*a* and the lower pulley 6*b*, being anchored at its other end to fastening means 9 such as an eye bolt to the inner surface of the lower flap door 13 at a point between its hinge 5*b* and its free distal edge.

The wire cable 8 is thus installed in a taut state. When the upper and lower flap doors 12 and 13 are fully closed, the above described balanced coupling mechanism is in the state shown in FIG. 2, in which the lever 7 is hanging substantially vertically from its pivot point.

When the lower flap door 13 is swung outward about its hinge 5*b*, it pulls downward on the lower end of the wire cable 8, which is thus pulled downward in its span between the upper and lower pulleys 6*a* and 6*b* and is therefore pulled upward in its span between the extreme bent end of the lever 7 and the upper pulley 6*a*. Consequently, the cable 8 imparts a clockwise torque (as viewed in FIGS. 2, 3, and 4) to the lever 7, which thereupon is forced to swing clockwise about its pivot point, thereby pushing against the inner surface of the upper flap door 12 to cause it to swing also in the clockwise (opening) direction.

Figure 3:
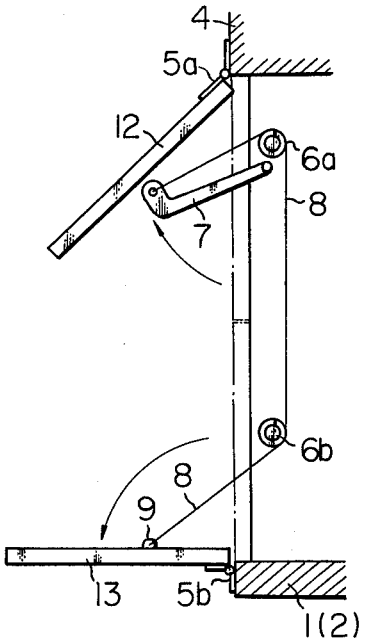

The state of the flap doors 12 and 13 and the balanced coupling mechanism at a point substantially halfway in the opening action of the flap doors is as indicated in FIG. 3. From this state, these parts are further moved in the opening action to the fully opened state indicated in FIG. 4.

The dimensions and positions of the various parts of the above described balanced coupling mechanism are appropriately selected so that the upper flap door 12 is thus swung through approximately 90° of angle while the lower flap door 13 is swung through approximately 180°, and so that the weight of (or force of gravity on) the lower flap door 13 is transmitted through the balanced coupling mechanism to counterbalance substantially the weight of (or force of gravity on) the upper flap door 12, acting in the opposite direction, throughout the greater part of the above described door opening operation.

By this provision, very little manual force is needed to initiate and carry through the door opening operation. In the door closing operation, the above described movements of parts and actions of forces, except gravitational force, are exactly reversed, but the balancing function of the balanced coupling mechanism is retained, whereby the flap doors 12 and 13 can be manually closed with very little force applied by hand.

A second embodiment of the invention will now be described with reference to FIGS. 5 through 8, in which parts which are the same as or equivalent to corresponding parts in FIGS. 1 through 4 are designated by like reference numerals and will not be described in detail again. This second embodiment of the invention is shown as being applied to a van type motortruck having on each lateral side thereof one pair of upper and lower flap doors 12 and 13 of relatively large size extending between front and rear posts 3. It is to be understood, however, that the balanced coupling mechanism of this second embodiment of the invention as described below can be used in arrangements, as shown in FIG. 1, wherein a plurality of pairs of upper and lower flap doors 12 and 13 are provided in a plurality of bays on each lateral side of the vehicle.

As in the preceding example, the upper and lower flap doors 12 and 13, which are similar to the flap doors in the preceding example, are adapted to be opened outward through approximately 90° and 180° of angle from their closed positions while being intercoupled in a balanced manner by a balanced coupling device comprising two balanced coupling mechanisms at the fore and aft ends of the flap doors. Also as in the preceding example, each mechanism has upper and lower pulleys 6*a* and 6*b*.

A lever 14 is pivotally connected at one end thereof to the inner part of the upper flap door 12 at a pivot point 14*a* intermediate between the hinge 5*a* and the free edge of the flap door. The other end of this lever 14 is provided with freely rotatable roller 11 adapted to roll along a vertical rail 10 fixed to the post 3 or parts of the upper frame member 4 and the lower peripheral frame 2. One end of a wire cable 8 is anchored to this lever 14 at a point thereof near its end bearing the roller 11. From this anchor point, the wire cable 8 is passed over the upper pulley 6*a* and then around the lower pulley 6*b* and is then anchored at its other end to fastening means 9 on the inner side of the lower flap door similarly as in the preceding example.

The wire cable 8 is thus installed in a taut state. When the upper and lower flap doors 12 and 13 are fully closed, the above described balanced coupling mechanism is in the state shown in FIG. 6, in which the lever 14 is in its lowest, almost vertical, position with the roller 11 at the lowest part of its path of rolling travel along the rail 10.

When the lower flap door 13 is swung outward about its hinge 5*a*, it pulls downward on the lower end of the wire cable 8, which is thus pulled downward in its span between the upper and lower pulleys 6*a* and 6*b* and is therefore pulled upward in its span between its end anchored to the end of the lever 14 and the upper pulley 6*a*. Consequently, the end of the lever 14 bearing the roller 11 is raised, the roller 11 rolling upward along the rail 10.

It is to be observed that the upper flap door 12 hinged at its hinge 5*a* to a fixed structure (4), the lever 14 pivotally connected at one end (14*a*) thereof to the upper flap door 12, and the rail 10 guiding the other end (11) of the lever 14 in linear movement and being integrally joined to the fixed structure (4) constitute a well known mechanism called a four-bar linkage with a sliding member. Accordingly, the above mentioned upward rolling movement of the end of the lever 14 bearing the roller 11 results in an upward displacement of the lever 14 which can be accommodated only by a rotation of the lever 14 in the counterclockwise direction as viewed in FIGS. 6 and 7 and an outward and upward (clockwise) swing of the upper flap door 12.

Figure 7:
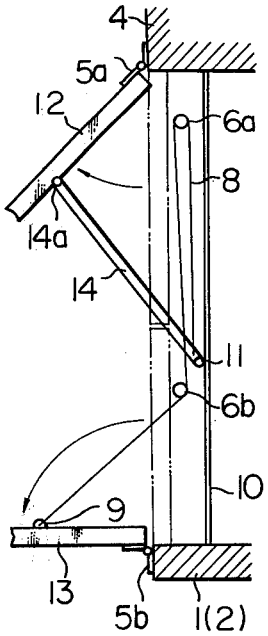
Figure 8:
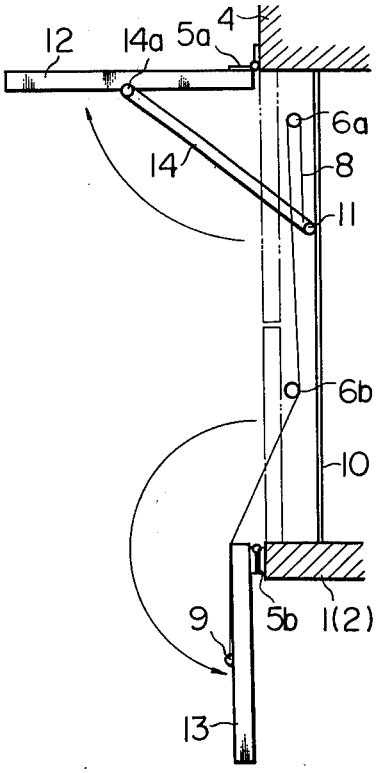

The state of the flap doors 12 and 13 and the balanced coupling mechanism at a point substantially halfway in the opening action of the flap doors is as indicated in FIG. 7. From this state, these parts are further moved in the opening action to the fully opened state indicated in FIG. 8.

As in the preceding first example, the dimensions and positions of the various parts of the above described balanced coupling mechanism are appropriately selected so that the upper flap door 12 is thus swung through approximately 90° of angle while the lower flap door 13 is swung through approximately 180°, and so that the weight of the lower flap door 13 is transmitted through the balanced coupling mechanism to counterbalance substantially the weight of the upper flap door 12, acting in the opposite direction, throughout the greater part of the above described door opening operation.

By provision, very little manual force is needed to initiate and carry through the door opening operation, similarly as in the preceding example. In the door closing operation, the above described movements of parts and actions of forces, except gravitational force, are exactly reversed, but the balancing function of the balanced coupling mechanism is retained, whereby the flap doors 12 and 13 can be manually closed with very little effort.

Thus, this invention provides flap doors which can be opened to open fully one side wall of a vehicle and, moreover, to swing completely clear of the possible path of the cargo being loaded onto or unloaded off the vehicle. Furthermore, this opening of the flap doors and closing thereof can be carried out manually with little effort and in a safe manner by the provision of a simple, inexpensive mechanism.

A preferred refinement of the above described balanced intercoupling device is an appropriate selection of the dimensions and positions of the various parts thereof whereby the upper and lower flap doors are in substantially stably counterbalanced state over most of their paths of movement and stop at any intermediate opening state when released from manual manipulation but become slightly unbalanced and tend to close automatically when they are near their closed positions and become slightly unbalanced and tend to open automatically to their fully opened positions when they are near these positions.

It should be understood, of course, that the foregoing disclosure relates to only preferred embodiments of the invention and that they are intended to cover all changes and modifications of the examples of the invention herein chosen for the purposes of the disclosure, which do not constitute departures from the spirit and scope of the invention. For example, while the invention has been described above with respect to its application to a van type motortruck, the invention is not so limited, it being applicable also to other vehicles such as cargo full trailers, cargo semitrailers, railway freight cars and to other structures such as cargo containers and other special storage structures.

Furthermore, while the invention has been described above with respect to examples in each of which each balanced coupling mechanism comprises pulleys, a lever, and a wire cable with the addition of a guide rail in the second example, the invention is in no way limited to such organization, it being possible to employ sprockets and a link chain in place of the pulley and wire cable. Another possibility is the use of other elements of mechanism such as gears and a torque rod to balance the gravitational forces on the upper and lower flap doors.

I claim:

1. An improved hollow structure comprising: a vertical wall part formed with an opening; a doorway frame bordering the opening and including a lower frame member, two vertical posts rising from opposite ends of the lower frame member, and an upper frame member disposed between the tops of the two posts; upper and lower flap doors respectively connected by upper and lower hinges to the upper and lower frame members and adapted to swing about the hinges to close and open upper and lower parts of the opening, the upper and lower flap doors each having inner and outer surfaces and being openable to respective fully-opened positions at which the flap doors are clear of possible paths of objects passing through the opening; and a coupling device for intercoupling the upper and lower flap doors in a manner synchronize the movements thereof between fully-closed positions thereof and said fully-opened positions and to cause the force of gravity acting on the upper and lower flap doors to substantially counterbalance each other, the improvement residing in that said coupling device comprises:

a. upper and lower guide wheels rotatably supported on said one of the posts;

b. a lever pivotally secured at a proximal end thereof to the inner surface of the upper flap door;

c. guide means for guiding and permitting the other distal end of the lever to move only in a substantially vertical and linear path, upward and downward movements of the distal end causing the upper flap door to move in the opening and closing directions; and d. an elongate flexible member anchored at one end thereof to the lever near the distal end thereof, passed over the upper guide wheel in an inverted U-shaped fashion and then over the lower guide wheel, and anchored at the other end thereof to the inner surface of the lower flap door, in a manner such that opening movement of the lower flap door causes the flexible member to be pulled at said other end thereof and to pull up said distal end of the lever thereby to open the upper flap door, and closing movement of the lower flap door permits the flexible member to move in reverse to permit the distal end of the lever to descend thereby to permit the upper flap door to move in the closing direction.

2. A structure as claimed in claim 1, wherein said upper and lower guide wheels are pulleys and said flexible member is a wire cable.

3. A structure as claimed in claim 1 in which the hollow structure is the cargo accommodating body part of a van type, motor-driven vehicle, and the upper and lower flap doors together with the coupling device thereof are adapted to open and close a large doorway opening in the side wall one each lateral side of the vehicle.

4. A structure as claimed in claim 1 in which the hollow structure is the cargo accommodating body part of a van type, motor-driven vehicle, and the upper and lower flap doors together with the coupling device thereof are adapted to open and close each of a plurality of large doorwary openings provided in tandem arrangement in the side wall on each lateral side of the vehicle.

5. A structure as claimed in claim 1 in which the coupling device accomplishes the counterbalancing function in a manner such that the upper and lower flap doors are in substantially stably counterbalanced state over most of their paths of movement and stop in any intermediate opening state when released from manual manipulation but become slightly unbalanced and tend to close automatically when they are near their closed positions and become slight unbalanced and tend to open automatically to their fully opened positions when they are near said fully opened positions.

* * * * *

UNITED STATES PATENT AND TRADEMARK OFFICE

CERTIFICATE OF CORRECTION

PATENT NO. : 4,024,671

DATED : May 24, 1977

INVENTOR(S) : Masao ISOBE

It is certified that error appears in the above-identified patent and that said Letters Patent are hereby corrected as shown below:

On the cover sheet, left column, in the Foreign Application Priority Data, "Feb. 1, 1975" should read-- May 28, 1975--.

Signed and Sealed this

*ninth* Day of *August 1977*

[SEAL]

*Attest:*

RUTH C. MASON
*Attesting Officer*

C. MARSHALL DANN
*Commissioner of Patents and Trademarks*